US011839952B2

(12) United States Patent
Dillenberger

(10) Patent No.: US 11,839,952 B2
(45) Date of Patent: Dec. 12, 2023

(54) VISE APPARATUS

(71) Applicant: North Valley Development, LLC, Klamath Falls, OR (US)

(72) Inventor: Eric Dillenberger, Klamath Falls, OR (US)

(73) Assignee: North Valley Development, LLP, Klamath Falls, OR (US)

( * ) Notice: Subject to any disclaimer, the term of this patent is extended or adjusted under 35 U.S.C. 154(b) by 45 days.

(21) Appl. No.: 17/517,575

(22) Filed: Nov. 2, 2021

(65) Prior Publication Data

US 2022/0134513 A1 May 5, 2022

Related U.S. Application Data

(60) Provisional application No. 63/204,948, filed on Nov. 5, 2020.

(51) Int. Cl.
*B25B 1/24* (2006.01)

(52) U.S. Cl.
CPC ..... *B25B 1/2463* (2013.01); *B25B 1/2452* (2013.01)

(58) Field of Classification Search
CPC ..... F16B 2/14; B25B 1/08; B25B 5/08; B25B 1/2405; B25B 1/2463; B25B 1/2452; B25B 1/241; B25B 1/2489; B25B 1/10; B25B 1/02
USPC ..... 254/104; 248/188.2; 269/257
See application file for complete search history.

(56) References Cited

U.S. PATENT DOCUMENTS 8,925,258 B1 * 1/2015 Header ..... E06B 3/70 52/767
11,077,531 B2 * 8/2021 Chang ..... B25B 1/02

OTHER PUBLICATIONS

Martin Stallion Shelf Unit Trunnion Table product description, https://www.trunniontable.com/shelf.html, 2020, 7 pages.

* cited by examiner

*Primary Examiner* — Tyrone V Hall, Jr.
*Assistant Examiner* — Abbie E Quann
(74) *Attorney, Agent, or Firm* — Berkeley Law & Technology Group, LLP

(57) ABSTRACT

Example implementations relating to a mechanical vise are disclosed herein. In one particular implementation, a first jaw piece includes a first slip surface a second jaw piece includes a second slip surface. The first slip surface may be moveable with respect to the second slip surface, while in slip contact with the second slip surface, to at least in part apply a force against a workpiece.

10 Claims, 12 Drawing Sheets

VISE APPARATUS

This application claims priority to U.S. Provisional Patent Application No. 63/204,948 titled "A Small Footprint Vise for Clamping Strips of Material," filed on 5 Nov. 2020, and incorporated herein by reference in its entirety.

BACKGROUND

1. Field

The present disclosure relates generally to for use in a manufacturing environment.

2. Information

Machine tools used in a machine shop typically include a vise for holding in place a workpiece. in one example, device may be used in combination with a rotating tombstone to, for example, allow for machining on three sides of a workpiece. Devices used in a machine shop two steady work pieces in place, such as in combination with a rotating tombstone, typically include many different moving parts that take up a significant amount of workspace.

BRIEF DESCRIPTION OF THE DRAWINGS

Claimed subject matter is particularly pointed out and distinctly claimed in the concluding portion of the specification. However, both as to organization and/or method of operation, together with objects, features, and/or advantages thereof, it may be best understood by reference to the following detailed description if read with the accompanying drawings in which:

Figure 1:
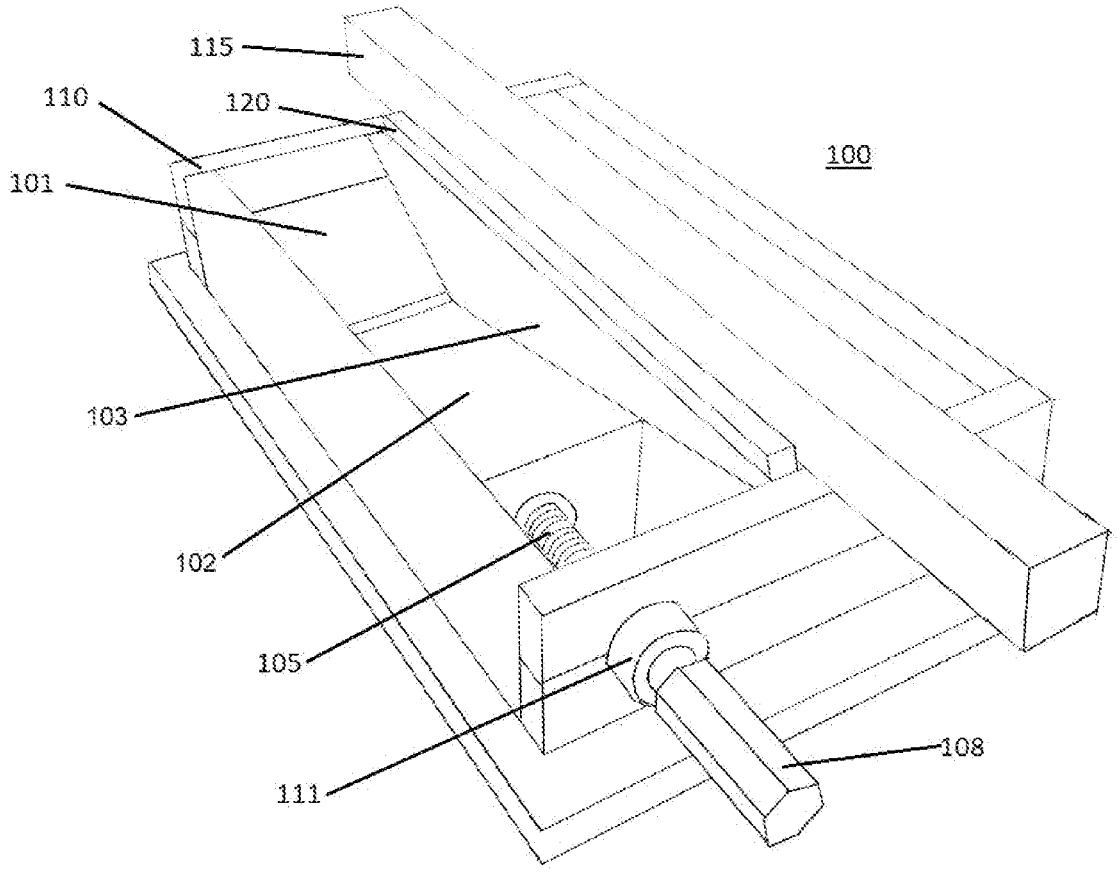
FIG. 1 is a perspective view of a mechanical vise apparatus according to an embodiment.

Reference is made in the following detailed description to accompanying drawings, which form a part hereof, wherein like numerals may designate like parts throughout that are corresponding and/or analogous. It will be appreciated that the figures have not necessarily been drawn to scale, such as for simplicity and/or clarity of illustration. For example, dimensions of some aspects may be exaggerated relative to others. Further, it is to be understood that other embodiments may be utilized. Furthermore, structural and/or other changes may be made without departing from claimed subject matter. References throughout this specification to "claimed subject matter" refer to subject matter intended to be covered by one or more claims, or any portion thereof, and are not necessarily intended to refer to a complete claim set, to a particular combination of claim sets (e.g., method claims, apparatus claims, etc.), or to a particular claim. It should also be noted that directions and/or references, for example, such as up, down, top, bottom, and so on, may be used to facilitate discussion of drawings and are not intended to restrict application of claimed subject matter. Therefore, the following detailed description is not to be taken to limit claimed subject matter and/or equivalents.

DETAILED DESCRIPTION

References throughout this specification to one implementation, an implementation, one embodiment, an embodiment and/or the like means that a particular feature, structure, and/or characteristic described in connection with a particular implementation and/or embodiment is included in at least one implementation and/or embodiment of claimed subject matter. Thus, appearances of such phrases, for example, in various places throughout this specification are not necessarily intended to refer to the same implementation or to any one particular implementation described. Furthermore, it is to be understood that particular features, structures, and/or characteristics described are capable of being combined in various ways in one or more implementations and, therefore, are within intended claim scope, for example. In general, of course, these and other issues vary with context. Therefore, particular context of description and/or usage provides helpful guidance regarding inferences to be drawn.

As pointed out above, devices to steady a workpiece in place in a machine shop environment typically include, collectively, multiple different tools and/or machining parts that take up a significant amount of workspace. Embodiments described herein include features of a vise that may be used in a machine shop, and that may replace multiple different tools to be used in holding a workpiece in place. In one particular implementation, a vise apparatus may include at least a first jaw member having a first slip surface and a second jaw member having a second slip surface that engages in slip contact with the first slip surface. The first and second slip surfaces may be movable relative to each to each other while maintaining slip contact to apply force against a workpiece to hold the workpiece in place.

Figure 2:
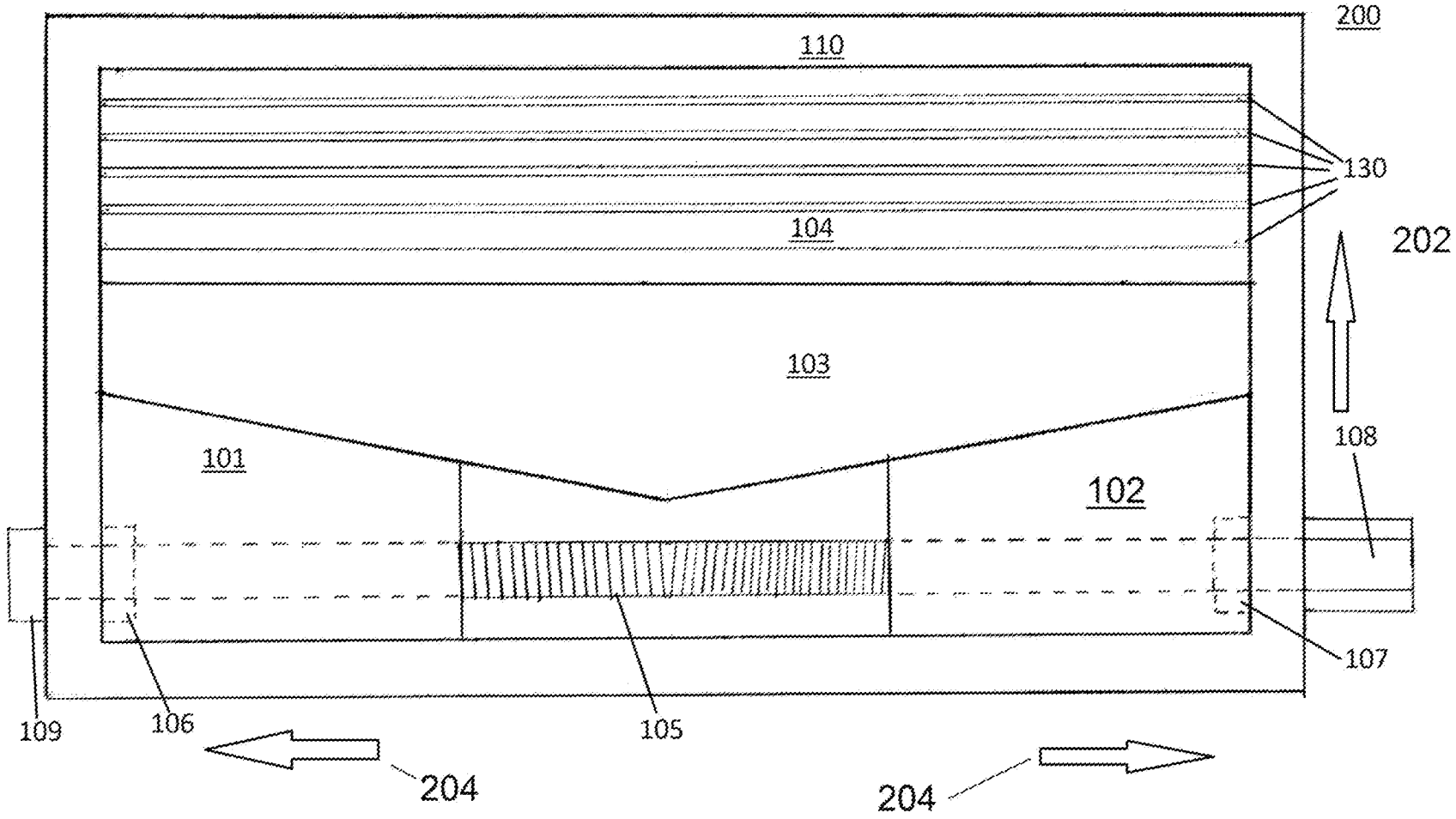
FIG. 2 is a plan view of a portion of a mechanical vise apparatus according to an embodiment.
Figure 5A:
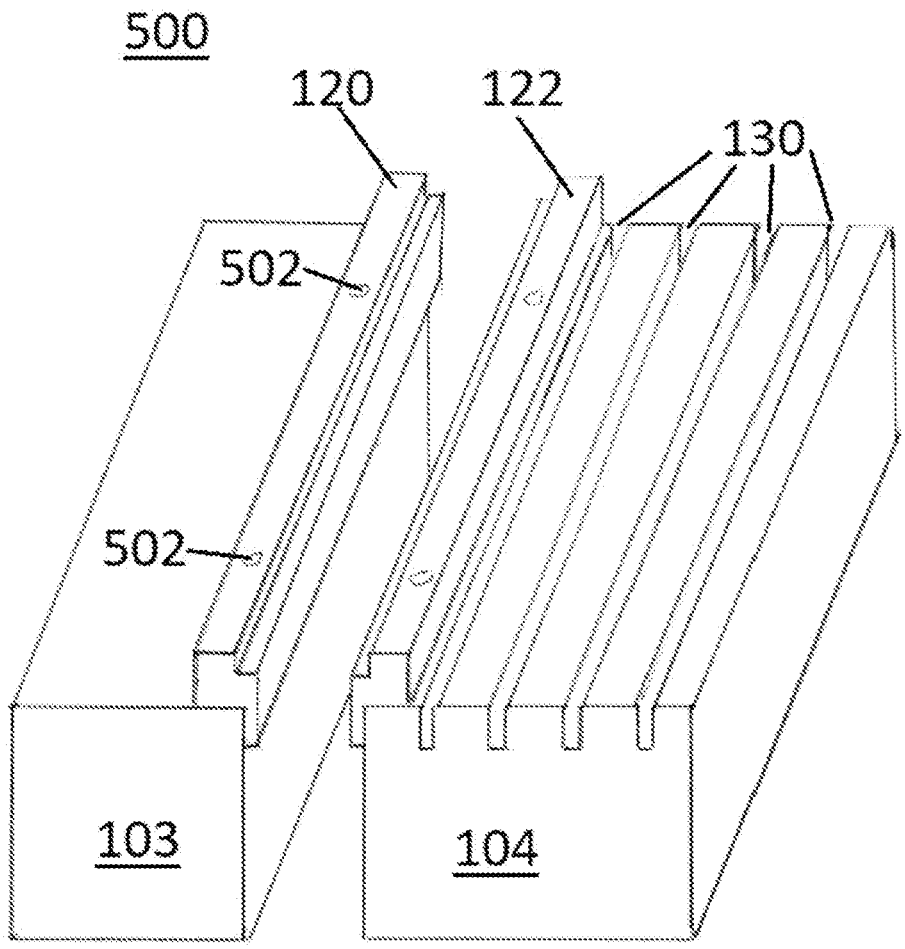
FIG. 5A is a perspective view of a portion of a vise apparatus having opposing clamping members, according to an embodiment.
Figure 5B:
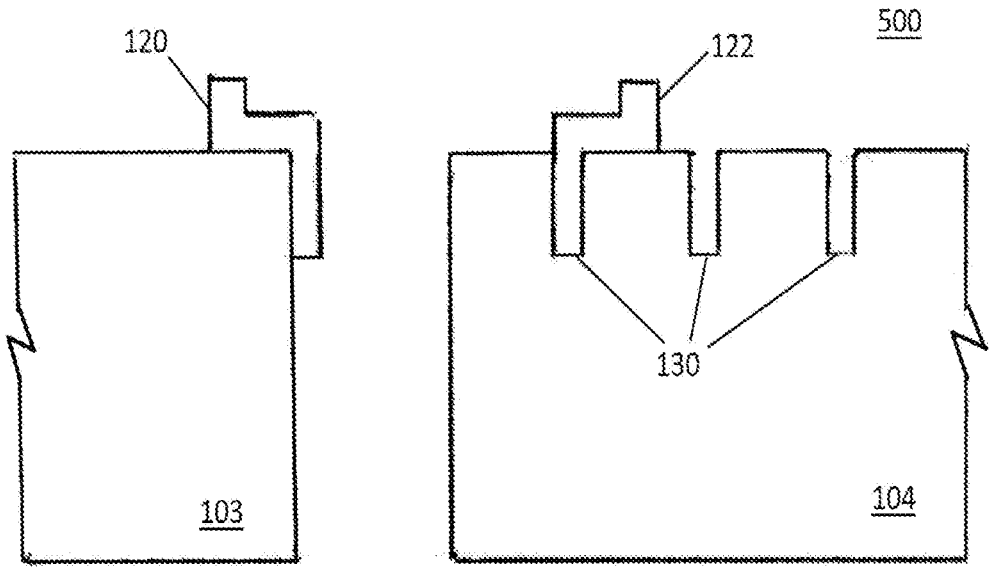
FIG. 5B is a cross-section view of a portion of a vise apparatus having opposing clamping members, according to an embodiment.

According to environment, view 100 in FIG. 1 and view 200 in FIG. 2 show features of vise apparatus to secure a workpiece 115. According to an embodiment, jaw piece 101 and jaw piece 102 may be moved closer together, or further apart along a dimension 204 by rotation of left right screw 105. Jaw pieces 101 and 102 each have a slip surface that engages with associated slip surfaces of jaw piece 103. As jaw pieces 101 and 102 move toward each other along dimension 204, jaw piece 103 may be translated in a direction 202 to apply a clamping force to workpiece 115 against jaw piece 103. According to an embodiment, jaw piece 104 may be stationary while jaw piece 103 moves toward jaw piece 104 along dimension 202. In a particular implementation, a clamping feature 120 may be secured to jaw piece 103 and an opposing clamping feature 122 (FIGS. 5A and 5B) may be secured to jaw piece 104. According to an embodiment, clamping feature 120 may be fixedly attached to a surface of jaw piece 103. For example, clamping feature may be attached to jaw piece with screws or rivets 502. However, clamping feature 122 may be positioned in any one of multiple slots 130 depending on a desired size of a clamping cavity to match an associated workpiece of a particular size. Here, it may be recognized that, while jaw pieces 103 and 104 may have a limited maximum range of separation, movement of clamping member 122 to different slots 130 may enable securing workpieces of many different sizes to, in effect, extend a range of vise jaws.

According to an embodiment, a torque applied to left-right screw 105 in one rotational direction may translate to a force applied in direction 202 as jaw pieces 101 and 102, again having slip surfaces in contact with slip surfaces of jaw piece 103, are moved together. Likewise, as a torque is applied to left-right screw 105 in an opposite rotational direction, jaw piece 103 may be allowed to separate from jaw piece 104. As such, a force to be applied to jaw piece 103 is perpendicular to an axis of rotation upon which a torque is applied to left-right screw 105. This may allow for space savings.

Figure 5C:
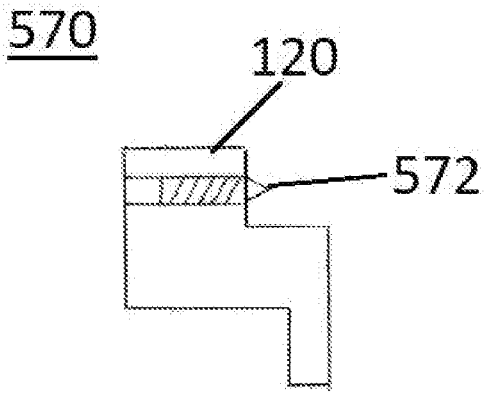
FIG. 5C is a cross-section view of a clamping member that includes a spike to secure a workpiece in place, according to an embodiment.

According to an embodiment, a width of a slot 130 may be matched with a thickness of a flange of clamping member 122 to allow clamping member 122 to be snuggly disposed in and/or removed from a slot 130, while maintaining a secure position while clamping a workpiece in place. Clamping members 120 and 122 may include non smooth surfaces that are to be in contact with workpiece to secure the workpiece against the clamping surfaces with a static frictional force. Alternatively, clamping member 120 and or 122 may include small spikes capable of indenting and/or dimpling a surface in contact with the workpiece. This may not only assist in maintaining a position of the workpiece, but provide for easy realignment of the workpiece by matching the spikes with previously created dimples. This is shown, for example, in an implementation of FIG. 5C in which a pointed spike member 572 is disposed and secured in a bore formed in a sidewall portion of clamping member 120.

Figure 3:
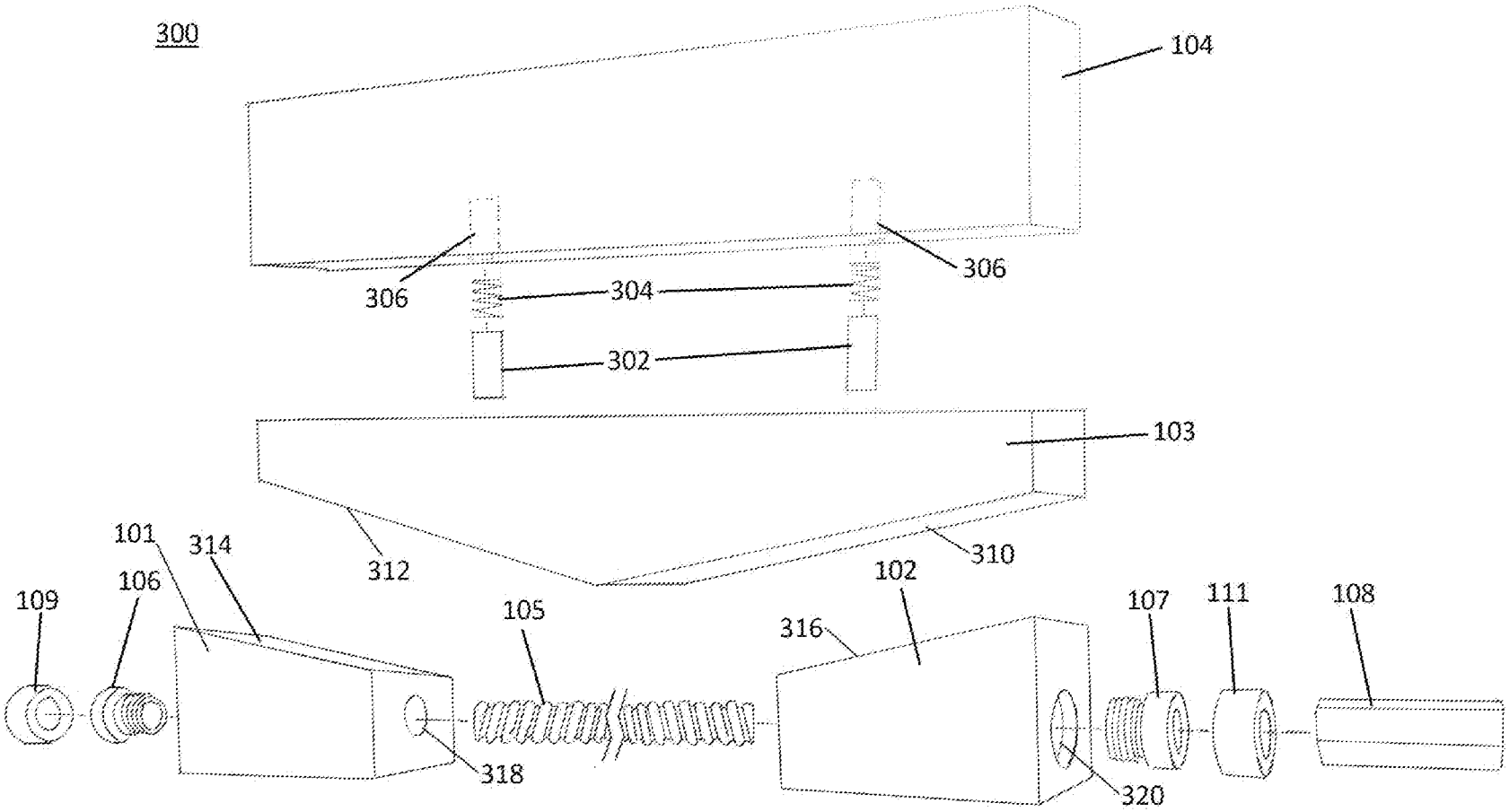
FIG. 3 is a schematic diagram of parts that may be assembled into a mechanical vise according to an embodiment.

View 300 shown in FIG. 3 shows parts that may be assembled to be housed within housing 110 to, at least in part, form a vise apparatus. According to an embodiment, jaw pieces 101, 102, 103 and 104 may be formed from any suitable metal such as aluminum or steel, using one or a mixture of processes such as forging or billet machining according to dimensions and within specified tolerances. Alternatively, jaw pieces 101, 102, 103 and 104 may be formed from a carbon fiber composite and/or strengthened polymer. Slip surface 310 of jaw piece 103 may be adapted to engage slip surface 314 of jaw piece 101 while slip surface 312 of jaw piece 103 may be adapted for slip engagement with slip surface 316 of jaw piece 102. Slip services 310, 312, 314 and 316 may be polished and/or lubricated to allow jaw pieces 101 and 102 move together and separate with minimal friction as slip surface 314 moves while in slip contact with slip surface 310 and as slip surface 316 moves while in slip contact with slip surface 312.

Left-right screw 105 may be disposed through hole 318 of jaw piece 101 and hole 320 of job piece 102. According to an embodiment, exterior threading of right hand nut 106 may engage similar threading provided in hole 318 to secure left-hand nut 106 in place in jaw piece 101. Likewise, exterior threading of right-hand nut 107 may engage similar threading formed in hole 320 to secure left-hand nut 107 in place in jaw piece 102. Interior threading of left-hand nut 106 and right-hand nut 107 may be adapted to engage threading at opposite ends of left-right screw 105. Hex driver 108 may be disposed and/or fitted in right-hand nut 107, and may translate an applied torque to left-right screw 105. In a particular implementation, left-right screw 105 may be cylindrical to fit within in diameters of collars 109 and 111 to secure and may be affixed to hex driver 108 by a welding joint. Collars 109 and 111 may be attached to left-right screw 105 with a set screw (not shown) on a flat surface (not shown) or dowel pins.

According to embodiment, cavities 306 may be formed in jaw piece 104 to receive springs 304 and rod pieces 302. In a particular implementation, springs 304 may be compressed as jaw piece 103 is moved in a direction 202 as jaw pieces 101 and 102 are brought closer together (e.g., from application of a torque apply to hex driver 108). Likewise, springs 304 may expand in response to an increasing a separation between jaw pieces 101 and 102 (e.g., from application of a torque to hex driver 108 in an opposite rotational direction). As such, rod pieces 302 may be pressed against jaw piece 103 as springs 304 expand. This may allow a separation between jaw pieces 103 and 104 as the vise is opened by application of a torque to hex nut 108 to increase the separation between jaw pieces 101 and 102.

Figure 4:
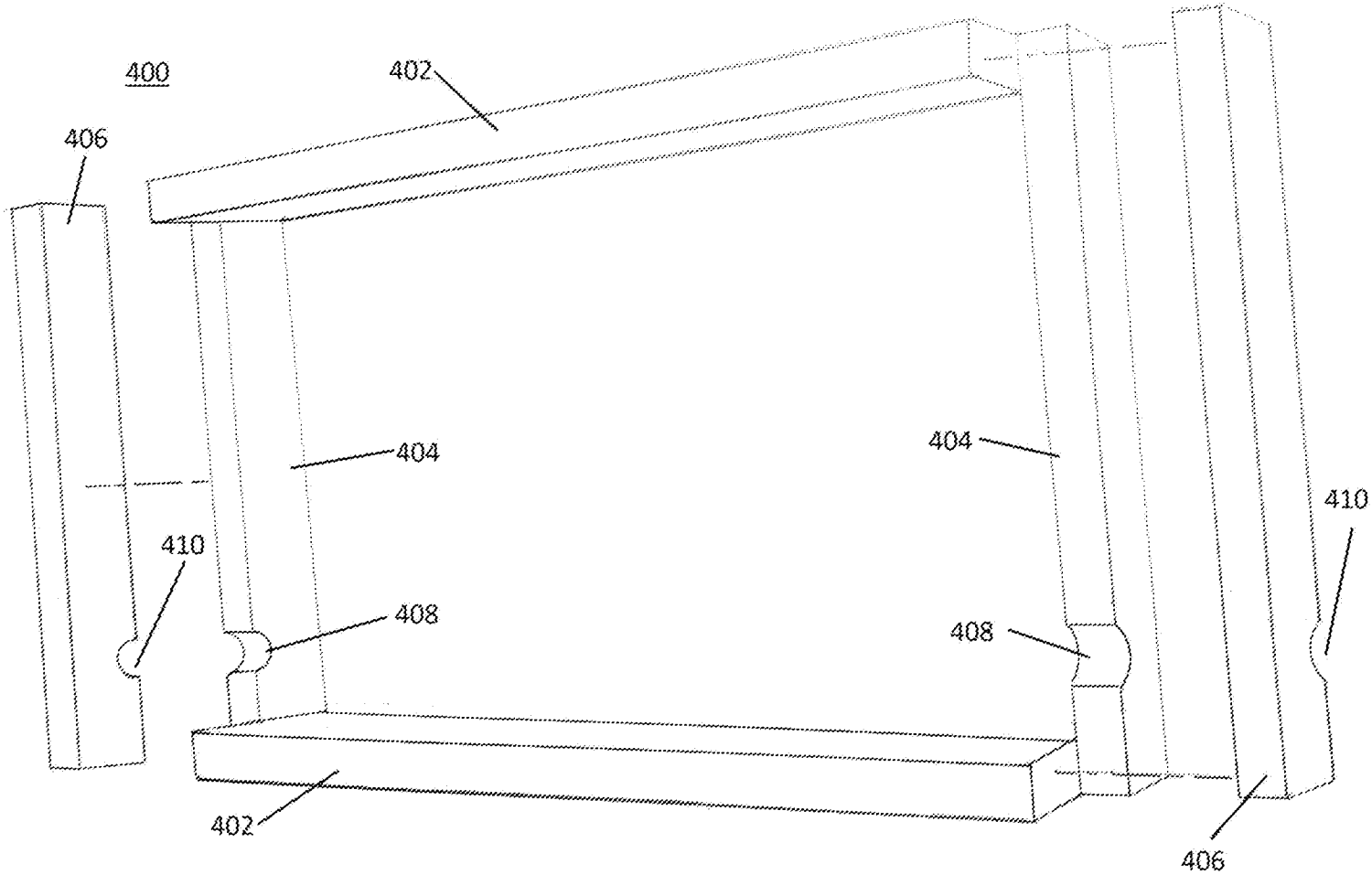
FIG. 4 is a schematic diagram of parts that may be assembled into a housing for a mechanical vise apparatus, according to an embodiment.

According to an embodiment, parts shown in view 300 of FIG. 3 may be disposed within a housing 110 that may be assembled as shown in FIG. 4. Here, sides 402 may bracket assembled parts of a vise (e.g., as shown in FIG. 3), and may be disposed in a parallel orientation as shown. In a particular implementation, jaw pieces 101 and 102 may abut a first side 402 while jaw piece 104 may abut a second side 402 opposing the first side 402. According to embodiment, an interface between slip surfaces of the first side 402 and slip surfaces of jaw pieces 101 and 102 may be lubricated to allow jaw pieces 101 and one or two to move closer together or further apart along dimension 204 (e.g., responsive to a torque applied to hex driver 108). Side pieces 404 and 406 may be attached so as to abut side pieces 402. In an embodiment, side pieces 404 in 406 may be fixedly attached to side pieces 402 using screws or dowel joints, just to provide a couple of examples of how side pieces of a housing may be attached to one another. Side pieces 406 may include a semicircular cut out 410 while side pieces 404 may include a semicircle cut out 408 that, in an assembled housing 110, provide a circular hole enabling left right screw 105 to pass therethrough. Sides 404 and/or 406 may be formed from steel, aluminum and/or other suitable metal using a forging and/or billet machining process with suitable tolerances. Alternatively, sides 404 and/or 406 may be formed from carbon fiber and/or a strengthened polymer. A surface of a side 402 to be in contact with jaw piece 101 and/or 102 may be polished and/or lubricated to form an additional slip surface to be in contact with corresponding slip surfaces of jaw piece 101 and/or 102. In an alternative implementation, sides 402 and 404 in combination with a base plate (not shown) may be cast formed or billet machined as a single solid piece.

Figure 6A:
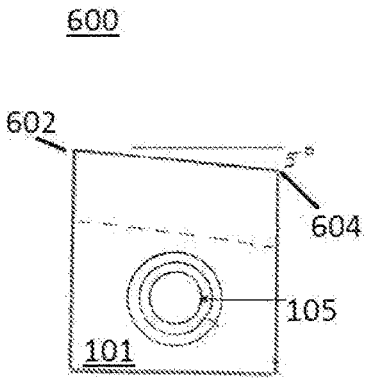
FIGS. 6A, 6B, 6C and 6D are views of jaw members including slip surfaces that are sloped in two dimensions, according to an embodiment.
Figure 6B:
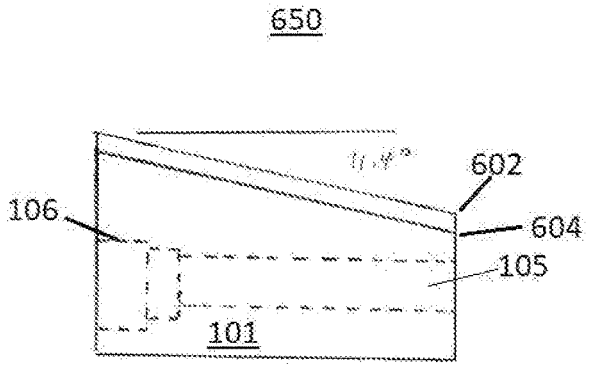
Figure 6C:
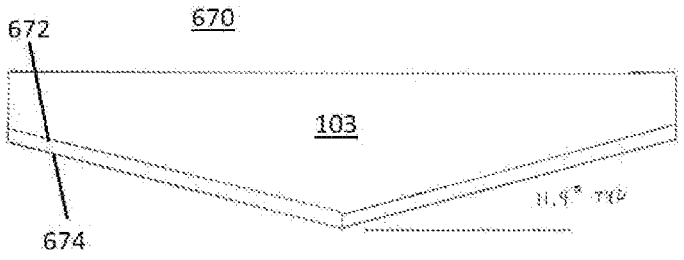
Figure 6D:
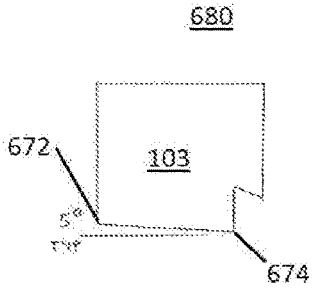

FIGS. 6A, 6B, 6C and 6D are views of jaw members including slip surfaces that are sloped in two dimensions, according to an embodiment. FIGS. 6A and 6B show different views of an alternative implementation of jaw piece 101 in which a slip surface is sloped at 11.4 degrees along a direction parallel to left-right screw 105 and sloped at five degrees between edges 602 and 604 (perpendicular to left-right screw 105). An alternative implementation of jaw piece 102 (not shown in FIG. 6A or 6B) may have a similar slip surface that is sloped in two dimensions. Likewise, FIGS. 6C and 6D show different views of an alternative implementation of jaw piece 103 in which a slip surface is sloped at about 11.4 degrees along a direction parallel to left-right screw 105 and sloped at about five degrees between edges 672 and 674 (in a direction perpendicular to left-right screw 105). It should be understood that such slopes of about 11.4 degrees and about five degrees as shown in FIGS. 6A and 6B are merely examples of how a slip surface may be sloped in two dimensions, and that slopes of different amounts may be used without deviating from claimed subject matter. While slopes of jaw pieces 101 and 103 along a direction parallel to left-right screw 105 may enable translation of an applied torque to a force on jaw piece 103, slopes in a direction perpendicular to left-right screw 105 may enable stabilizing jaw piece 103 while such a force is applied to jaw piece 103. For example, slope surfaces of jaw pieces 101 and 103 may engage in a slip contact such that edge 602 of jaw piece 101 meets edge 672 of jaw piece 103 and such that edge 604 of jaw piece 101 meets edge 674 of jaw piece 103. Such an engagement of slope surfaces of jaw pieces 101 and 103 may prevent jaw piece 103 from rising as a force is applied.

Figure 7:
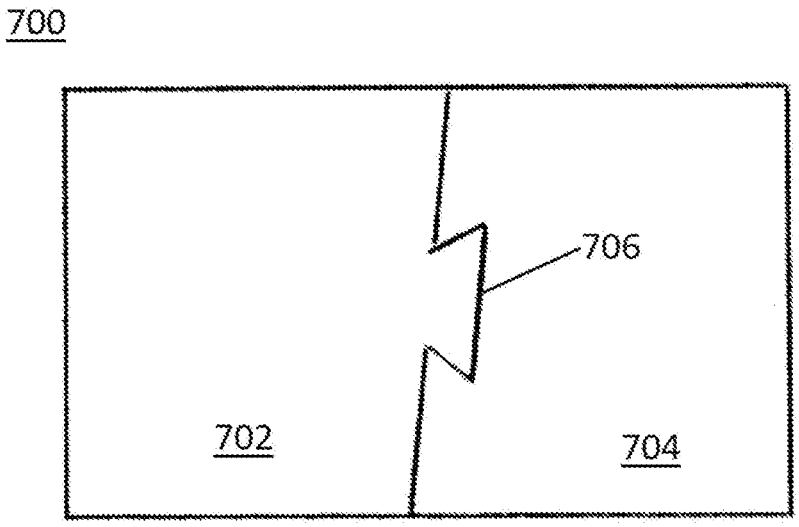
FIG. 7 is a schematic diagram of a dovetail joint to extend along slip surfaces of jaw members of a vise apparatus according to an alternative embodiment.
Figure 8A:
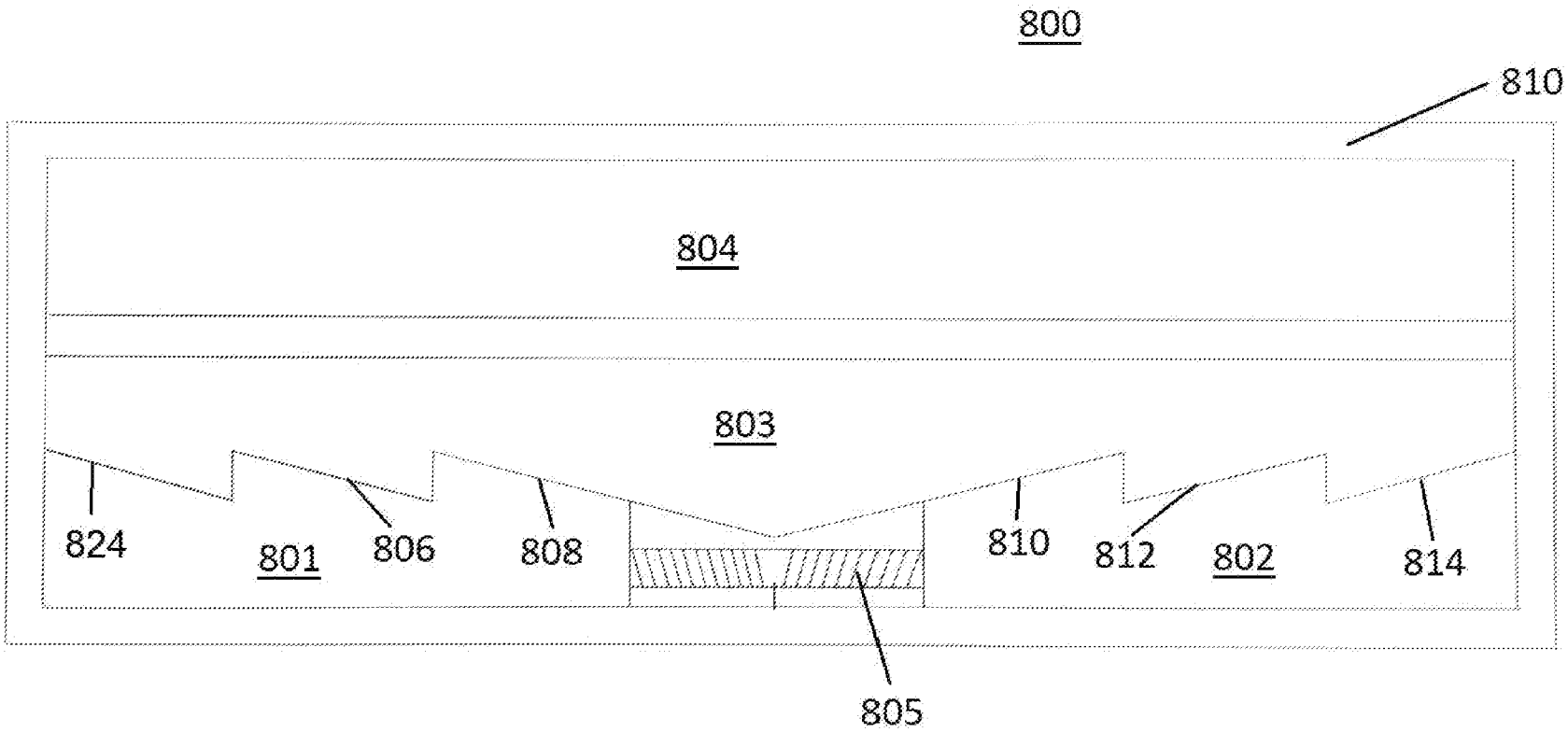
FIGS. 8A and 8B are plan views of a feature of an alternative implementation of a vise apparatus, according to an embodiment.
Figure 8B:
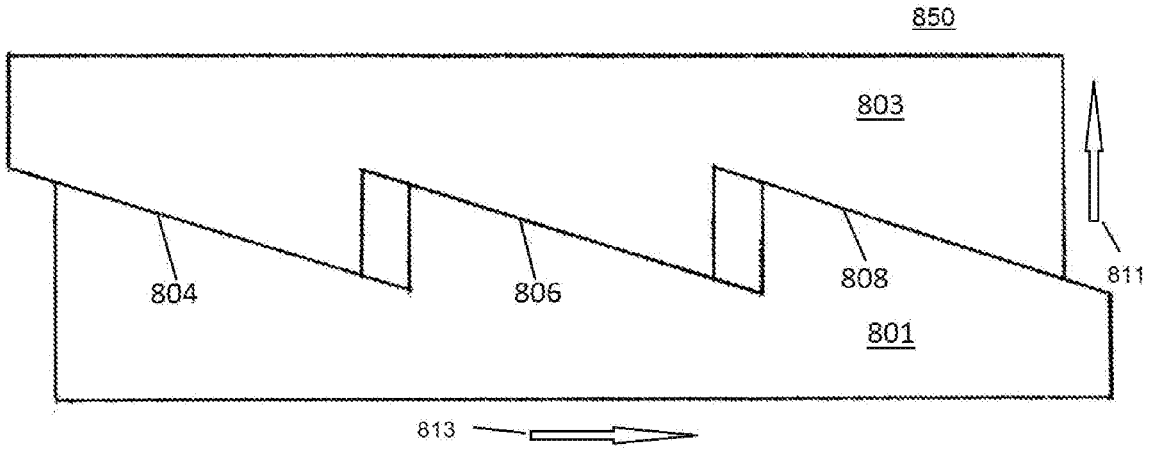

As discussed in the particular implementation of FIG. 3, springs 304 and rod pieces 302 disposed in cavities 306 may return jaw piece to an open position as jaw pieces 101 and 102 are separated (e.g., responsive to a torque applied to hex driver 108). In an alternative implementation as shown in FIG. 7, slip surfaces of jaw piece 103 and either jaw piece 101 or 102 may comprise a dovetail joint that runs the length of slip surfaces that are in slip contact. For example, view 700 may comprise a cross-section view of a slip contact engagement of a slip surface of jaw piece 101 (implemented as a jaw piece 702) and a slip surface of jaw piece 102 (implemented as a jaw piece 704) forming a dovetail joint 706 running a length of the engaged slip surfaces. Slip surfaces of jaw piece 102 and 103 engaged in slip contact may similarly form a dovetail joint (not shown). As such, as jaw piece 101 is separated from jaw piece 102, dovetail joints formed by slip surfaces of jaw pieces 101, 102 and 103 may tend to retract jaw piece 103. FIGS. 8A and 8B show an alternative embodiment in which a jaw piece 801 may replace jaw piece 101, jaw piece 802 may replace jaw piece 102 and jaw piece 808 may replace jaw piece 803. Here, jaw pieces 801 and 802 each include three distinct slip surfaces meeting with corresponding slip surfaces of jaw piece 803. For example, jaw piece 801 comprises three distinct slip surfaces that engage corresponding slip surfaces of jaw piece 803 at interfaces 824, 806 and 808. Likewise, jaw piece 802 comprises three distinct slip surfaces that engage corresponding slip surfaces of jaw piece 803 at interfaces 810, 812 and 814. If jaw pieces 801 and 802 are moved toward one another (e.g., from application of a torque to left-right screw 805), a force may be applied to jaw piece 803 in a direction toward jaw piece 804 (e.g., to secure a workpiece).

As may be observed, slip surfaces of jaw pieces 801 and 802 to be in slip contact with jaw piece 803 all begin and end at the same separation from a bottom side of housing 810. As such, for slope surfaces of a particular slope angle, a force applied to jaw piece 803 (e.g., by application of a torque to left-right screw 805) may be distributed over a longer dimension. In an embodiment, multiple slip surfaces on jaw piece 801 may move in a direction 813 relative to jaw piece 803 to apply a force in a direction 811 and apply a clamping force to an opposing jaw piece (not shown). In one embodiment, jaw piece 801 may be translated bidirectionally along dimension 810 responsive to a torque applied to left-right screw 805.

Figure 9A:
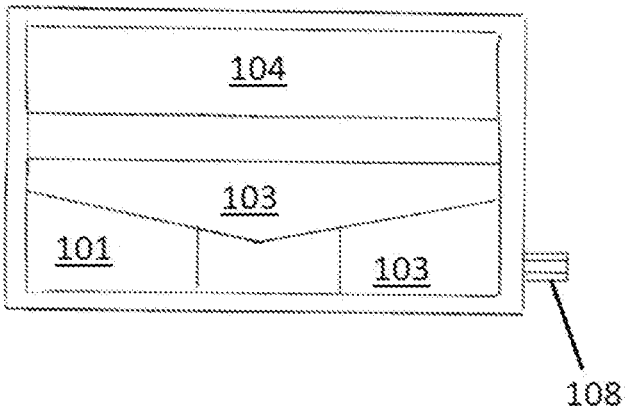
FIGS. 9A and 9B illustrate different embodiments of a machine vise.
Figure 9B:
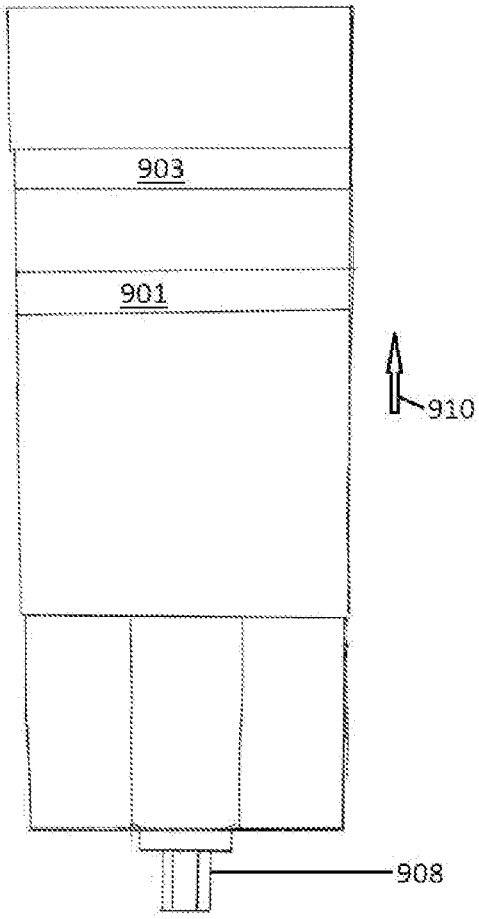

FIGS. 9A and 9B provide a side-by-side comparison of features of a vise according to FIGS. 1-7 (in FIG. 9A) and a vise that translates a torque applied to an axis in a direction of force 910 to be applied to against a workpiece to hold the workpiece in place. As may be observed, features of the particular embodiment of FIG. 9A may enable implementation of a device (to secure a workpiece) that is more compact.

Figure 10C:
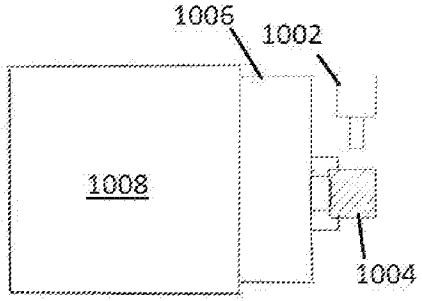
FIGS. 10A through 10C are views of a machine vise and workpiece secured in a rotating tombstone, according to an embodiment.
Figure 10B:
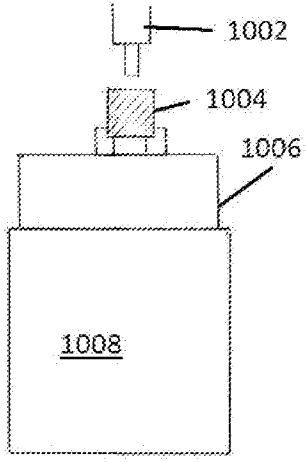
Figure 10A:
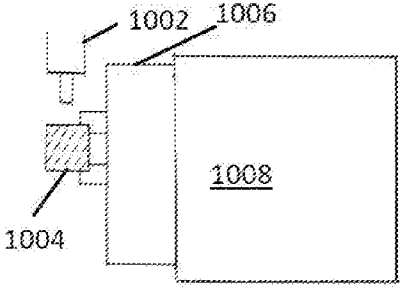

FIGS. 10A through 10C are views of a machine vise and workpiece secured in a rotating tombstone, according to an embodiment. A vise 1006 may be secured to a rotating tombstone 1008. According to an embodiment, features of vise 1006 may be as shown in FIGS. 1 through 8B to, for example, enable securing workpiece 1004 in place. According to an embodiment, vertical drill 1002 may be limited to application of a drill bit only in an up-down dimension. As rotating tombstone 1008 is rotated to different positions by ninety-degree increments, vertical drill 1002 may apply a drill bit to different surfaces of workpiece 1008. Here, implementing features of embodiments shown in FIGS. 1 through 8B, vise 1006 may enable securing workpiece 1004 using minimal parts and occupying minimal space.

In the drawings and/or description, as was indicated, like parts and/or features are typically marked throughout the specification and/or drawings with the same reference numerals, respectively, if applicable. Again, the drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed herein may be employed separately or in any suitable combination to produce desired results.

While there has been illustrated and described what are presently considered to be example features and/or aspects, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter may also include all aspects falling within the scope of the appended claims, and equivalents thereof.

The terms, "and", "or", "and/or" and/or similar terms, as used herein, include a variety of meanings that also are expected to depend at least in part upon the particular context in which such terms are used. Typically, "or" if used to associate a list, such as A, B or C, is intended to mean A, B, and C, here used in the inclusive sense, as well as A, B or C, here used in the exclusive sense. In addition, the term "one or more" and/or similar terms is used to describe any feature, structure, and/or characteristic in the singular and/or is also used to describe a plurality and/or some other combination of features, structures and/or characteristics. Likewise, the term "based on" and/or similar terms are understood as not necessarily intending to convey an exclusive set of factors, but to allow for existence of additional factors not necessarily expressly described. Of course, for all of the foregoing, particular context of description and/or usage provides helpful guidance regarding inferences to be drawn. It should be noted that the following description merely provides one or more illustrative examples and claimed subject matter is not limited to these one or more examples; however, again, particular context of description and/or usage provides helpful guidance regarding inferences to be drawn.

What is claimed is:

1. A vise comprising: a first jaw piece to comprise at least a first slip surface; a second jaw piece to comprise at least a second slip surface: a third jaw piece to comprise third slip surface, wherein the third slip surface is moveable with respect to the first slip surface while in slip contact with the first slip surface, and to comprise a fourth slip surface, wherein the fourth slip surface is movable with respect to second slip surface while in slip contact with the second slip surface: a left-right screw having threads at a first end to mate with the first jaw piece and threads at a second end to mate with the second jaw piece: and a first clamping member disposed on the third jaw piece to be in contact with a workpiece and a second clamping member disposed on a fourth jaw piece, wherein: the workpiece is secured between the first and second clamping members responsive to a force; the first jaw piece and second jaw piece are movable toward one another while the third slip surface is in slip contact with the first slip surface and while the fourth slip surface is in contact with the second slip surface in response to a torque applied to the left-right screw to at least in part apply the force against the workpiece; the first clamping member or the second clamping member, or a combination thereof, is movable to accommodate workpieces of different sizes.

2. The vise of claim 1, wherein the first and second slip surfaces are oblique with respect to the left-right screw.

3. The vise of claim 2, wherein the torque is applied to the left-right screw about an axis and the direction of force is substantially perpendicular to the axis.

4. The vise of claim 2, wherein the third and fourth slip surfaces are oblique with respect to the direction of the force.

5. The vise of claim 1, wherein: the first jaw piece comprises a first plurality of slip surfaces to be in slip contact with a second plurality of slip surfaces formed on the third jaw piece; and the second jaw piece comprises a third plurality of slip surfaces to be in slip contact with a fourth plurality of slip surfaces formed on the third jaw piece.

6. The vise of claim 1, wherein the first clamping member or the second clamping member, or the combination thereof, comprise one or more spikes to secure the workpiece.

7. The vise of claim 6, wherein at least one of the one or more spikes are capable of indenting and/or dimpling the workpiece responsive to the force.

8. The vise of claim 1, wherein the first and second slip surfaces are sloped in two dimensions relative to a direction of the force.

9. The vise of claim 1, and further comprising one or more springs to return the third jaw piece to an open position responsive to a release of the force applied against the workpiece.

10. The vise of claim 1, wherein the first and second slip surfaces form a dovetail joint to maintain the first and second slip surfaces in contact as the force applied against the workpiece is released.

* * * * *